US008172560B2

(12) United States Patent
Masuda et al.

(10) Patent No.: US 8,172,560 B2
(45) Date of Patent: May 8, 2012

(54) FLUID MACHINERY HAVING ANNULAR BACK PRESSURE SPACE COMMUNICATING WITH OIL PASSAGE

(75) Inventors: Masanori Masuda, Sakai (JP); Yoshitaka Shibamoto, Sakai (JP); Kazuhiro Furusho, Sakai (JP); Kenichi Sata, Sakai (JP); Takazo Sotojima, Sakai (JP); Takashi Shimizu, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 275 days.

(21) Appl. No.: 12/517,847

(22) PCT Filed: Dec. 4, 2007

(86) PCT No.: PCT/JP2007/073393

§ 371 (c)(1),
(2), (4) Date: Jun. 5, 2009

(87) PCT Pub. No.: WO2008/069198

PCT Pub. Date: Jun. 12, 2008

(65) Prior Publication Data

US 2010/0322809 A1 Dec. 23, 2010

(30) Foreign Application Priority Data

Dec. 6, 2006 (JP) ..... 2006-329488

(51) Int. Cl.
*F03C 2/00* (2006.01)
*F04C 18/00* (2006.01)
*F04C 2/00* (2006.01)

(52) U.S. Cl. ..... 418/59; 418/55.5; 418/55.6; 418/57; 418/270

(58) Field of Classification Search ..... 418/55.1–55.6, 418/57, 59, 94, 270
See application file for complete search history.

(56) References Cited

U.S. PATENT DOCUMENTS

| | | | | |
|---|---|---|---|---|
| 4,596,520 | A * | 6/1986 | Arata et al. | 418/55.5 |
| 5,085,565 | A | 2/1992 | Barito | |
| 5,137,437 | A * | 8/1992 | Machida et al. | 418/55.1 |
| 7,419,370 | B2 * | 9/2008 | Masuda | 418/55.5 |
| 2006/0127263 | A1 * | 6/2006 | Hwang et al. | 418/59 |
| 2009/0142214 | A1 | 6/2009 | Furusho et al. | |

FOREIGN PATENT DOCUMENTS

| | | | |
|---|---|---|---|
| JP | 02-009973 | A | 1/1990 |
| JP | 04-234589 | A | 8/1992 |
| JP | 05-296163 | A | 11/1993 |
| JP | 07-051950 | B2 | 6/1995 |
| JP | 09-228968 | A | 9/1997 |
| JP | 11324945 | A * | 11/1999 |
| JP | 2005-147101 | A | 6/2005 |
| JP | 3696683 | B2 | 7/2005 |
| WO | WO-2006/126531 | A1 | 5/2006 |

* cited by examiner

*Primary Examiner* — Theresa Trieu
(74) *Attorney, Agent, or Firm* — Global IP Counselors

(57) ABSTRACT

A fluid machinery includes a rotary mechanism, an annular back pressure chamber and an oil passage. The rotary mechanism includes first and second cooperating members, each including an engaging member extending from an end plate, with the cooperating members being arranged to oscillate relative to each in order to change volumes of operation chambers formed between the cooperating members. The annular back pressure chamber is formed on the back surface side of the end plate of the first cooperating member, and communicates with an intermediate operation chamber of the operation chambers to thrust the first cooperating member against the second cooperating member. The intermediate operation chamber is in an intermediate pressure state. The oil passage is arranged to communicate an oil into the back pressure chamber to fill the back pressure chamber with the oil. The rotary mechanism can include a piston and cylinder, or can include a fixed and orbiting scroll.

12 Claims, 5 Drawing Sheets

FLUID MACHINERY HAVING ANNULAR BACK PRESSURE SPACE COMMUNICATING WITH OIL PASSAGE

CROSS-REFERENCE TO RELATED APPLICATIONS

This U.S. National stage application claims priority under 35 U.S.C. §119(a) to Japanese Patent Application No. 2006-329488, filed in Japan on Dec. 6, 2006, the entire contents of which are hereby incorporated herein by reference.

TECHNICAL FIELD

The present invention relates to fluid machineries, and particularly relates to a thrust mechanism of cooperating members.

BACKGROUND ART

Conventionally, fluid machineries include a scroll compressor used in an air conditioner, as disclosed in Japanese Unexamined Patent Application Publication No. 2005-147101. The scroll compressor includes a fixed scroll and an orbiting scroll including spiral wraps formed on the front surfaces of end plates. In a state that the scroll wraps are in engagement with each other, the orbiting scroll revolves with respect to the fixed scroll without rotating. This revolution compresses the volumes of compression chambers to compress the refrigerant.

On the back surface side of the orbiting scroll of the scroll compressor, a back pressure chamber is formed. The back pressure chamber communicates with a compression chamber in an intermediate pressure state, and the refrigerant at the intermediate pressure is introduced to the back pressure chamber. A predetermined amount of thrust force of the intermediate pressure refrigerant thrusts the orbiting scroll against the fixed scroll to remove a gap between the wraps and the opposed end plates. Further, when the compression chamber becomes at an abnormal high pressure, the abnormal high pressure is released between the wraps and the opposed end plates to the low pressure side.

SUMMARY OF THE INVENTION

Problems that the Invention is to Solve

However, in the conventional scroll compressor, the back pressure chamber merely communicates with the compression chamber in the intermediate pressure state, and gas refrigerant is always filled in the back pressure chamber.

Accordingly, since the fluid in the back pressure chamber is the gas refrigerant, i.e., compressive fluid, the pressure change in the compression chamber may cause pumping of the gas refrigerant in the back pressure chamber. Specifically, when the pressure of the compression chamber changes, the gas refrigerant in the back pressure chamber may be sucked, or the gas refrigerant may be forced into the back pressure chamber. This can result in power loss.

The present invention has been made in view of the foregoing, and its objective is to reduce power loss in the back pressure chamber.

Means for Solving the Problems

In the present invention, the back pressure chamber is filled with non-compressive fluid.

Specifically, a first aspect of the present invention is directed to a fluid machinery which includes a rotary mechanism (20), where a first cooperating member (21, 120) and a second cooperating member (22, 110) including engaging members (24, 25, 122, 22*a*, 112) formed on front surfaces of end plates (26, 121, 16*c*, 111) perforin circulation movement in parallel and relative to each other, the rotary mechanism (20) changing volumes of operation chambers (C1, C2, 100) formed between the cooperating members (21, 120, 22, 110). In the fluid machinery, an annular back pressure chamber (53) communicating with an operation chamber (C1 100) in an intermediate pressure state is provided at a back surface of an end plate (26, 121) of the first cooperating member (21, 120), and thrusts the first cooperation member (21, 120) against the second cooperating member (22, 110), and an oil passage (55) which directs oil communicates with the back pressure chamber (53) to fill the back pressure chamber (53) with the oil.

Referring to a second aspect of the present invention, in the first aspect, a back flow checking mechanism (60) is provided at the oil passage (55).

Referring to a third aspect of the present invention, in the second aspect, the back flow checking mechanism (60) is a one-way valve (60) closing when a pressure of the operation chamber (C1, 100) is equal to or higher than a predetermined high pressure.

Referring to a fourth aspect of the present invention, in the first aspect, a throttling mechanism (65) is provided at the oil passage (55).

Referring to a fifth aspect of the present invention, in the fourth aspect, the throttling mechanism (65) is a fluid diode (65).

Referring to a sixth aspect of the present invention, in any one of the first to fifth aspects, a high pressure chamber (50) kept in a high pressure state is formed on the back surface side of the end plate (26, 121) of the first cooperating member (21, 120) separately from the back pressure chamber (53).

Referring to a seventh aspect of the present invention, in any one of the first to sixth aspects, a constant pressure space (42) kept in a pressure state between a low pressure state and the intermediate pressure state is formed on a back surface side of the end plate (26, 121) of the first cooperating member (21, 120) separately from the back pressure chamber (53).

Referring to an eighth aspect of the present invention, in any one of the first to seventh aspects, a center of the back pressure chamber (53) is eccentric from an axial center of a drive shaft (33) driving the first cooperating member (21, 120).

Referring to a ninth aspect of the present invention, in any one of the first to eighth aspects, the operation chambers (C1, C2, 100) are located above the end plate (26, 121) of the first cooperating member (21, 120).

Referring to a tenth aspect of the present invention, in any one of the first to ninth aspects, the back surface of the end plate (26, 121) of the first cooperating member (21, 120) and an opposed surface of a housing (17, 130) opposed to the back surface are flat.

Referring to an eleventh aspect of the present invention, in any one of the first to tenth aspects, one of the two cooperating members (21, 22) is a cylinder (21) including an outside cylinder member (24) and an inside cylinder member (25) as engaging members, the outside cylinder member (24) and the inside cylinder member (25) being formed on a front surface of the end plate (26) to form an annular cylinder chamber (C1, C2), the other of the two cooperating members (21, 22) is a piston (22) which includes an annular piston member (22*a*) as an engaging member, the annular piston member (22*a*) being formed on a front surface of an end plate (16*c*), being accommodated in a cylinder chamber (C1, C2) with its center eccentric with respect to the cylinder (21), and defining the cylinder chamber (C1, C2) into an outside operation chamber (C1) and an inside operation chamber (C2), and the rotary mechanism (20) includes a blade (23) defining each operation chamber (C1, C2) into a high pressure side and a low pressure side and configured to allow the piston (22) and the cylinder (21) to perform relative rotation.

Referring to a twelfth aspect of the present invention, in any one of the first to tenth aspects, the first cooperating member (120) is an orbiting scroll (120) including a scroll wrap (122) as an engaging member formed on a front surface of the end plate (121), the second cooperating member (110) is a fixed scroll (110) including a scroll wrap (112) as an engaging member formed on a front surface of an end plate (111), and the rotary mechanism (20) is configured so that the orbiting scroll (120) revolves with respect to the fixed scroll (110) without rotating with the wraps (112, 122) of the fixed scroll (110) and the orbiting scroll (120) being in engagement with each other.

Referring to a thirteenth aspect of the present invention, in any one of the first to twelfth aspects, the rotary mechanism (20) is a compression mechanism compressing operation fluid.

Hence, in the first aspect of the present invention, the intermediate pressure of the operation chamber (C1, 100) works on the back pressure chamber (53) during the operation for changing the volume of the operation chambers (C1, C2, 100). Simultaneously, the oil is supplied to the back pressure chamber (53) through the oil passage (55). As a result, in the back pressure chamber (53), the oil is filled, and the intermediate pressure state is kept to thrust the first cooperating member (21, 120) against the second cooperating member (22, 110) by the intermediate pressure. Specifically, when the intermediate pressure is low due to change in pressure state of the operation chamber (C1, 100) by the movement of the first cooperating member (21, 120), this low pressure thrusts the first cooperating member (21, 120) against the second cooperating member (22, 110). As well, when the intermediate pressure is high, this high pressure thrusts the first cooperating member (21, 120) against the second cooperating member (22, 110).

In the second aspect of the present invention, the back flow checking mechanism (60) prevents back flow of the oil in the back pressure chamber (53). Specifically, in the third aspect of the present invention, when the pressure of the operation chamber (C1, 100) is equal to or higher than the predetermined high pressure, the one-way valve (60) is closed.

In the forth aspect of the present invention, the throttling mechanism (65) prevents the back flow of the oil in the back pressure chamber (53). Specifically, in the fifth aspect of the present invention, the fluid diode (65) prevents the back flow of the oil in the back pressure chamber (53).

In the sixth aspect of the present invention, the high pressure of the high pressure chamber (50) different from the back pressure chamber (53) thrusts the first cooperating member (21, 120) against the second cooperating member (22, 110).

In the seventh aspect of the present invention, the pressure of the constant pressure space (42) different from the back pressure chamber (53) thrusts the first cooperating member (21, 120) against the second cooperating member (22, 110).

In the eighth aspect of the present invention, the center of the back pressure chamber (53) is eccentric from the axial center of the drive shaft (33) driving the first cooperating member (21, 120), and the point of application of the thrust force agrees with the center of action of opposite thrust force against the first cooperating member (21, 120) when the opposite thrust force is maximum.

In the ninth aspect of the present invention, the operation chambers (C1, C2, 100) are located above the end plate (26, 121) of the first cooperating member (21, 120), thereby ensuring discharge of the gas fluid even when the gas fluid flows back into the oil passage (55).

In the tenth aspect of the present invention, the back surface of the end plate (26, 121) of the first cooperating member (21, 120) and the opposed surface of the housing (17, 130) opposed to the back surface are flat, and accordingly, the gas refrigerant can hardly be retained therebetween to reduce the oil agitation loss.

In the eleventh aspect of the present invention, the piston (22) and the cylinder (21) perform relative rotation, and the intermediate pressure of the cylinder chamber (C1) works on the back pressure chamber (53) so that one of the cylinder (21) and the piston (22) is thrust against the other.

In the twelfth aspect of the present invention, the orbiting scroll (120) revolves with respect to the fixed scroll (110) without rotating, and the intermediate pressure of the operation chambers (100) formed between the wraps (112, 122) works on the back pressure chamber (53) to thrust the orbiting scroll (120) against the fixed scroll (110).

Advantages of the Invention

In the present invention, the intermediate pressure of the back pressure chamber (53) at the back surface of the first cooperating member (21, 120) is changed according to the pressure state of the operation chamber (C1), and accordingly, the first cooperating member (21, 120) can be thrust against the second cooperating member (22, 110) by an appropriate amount of thrust force.

Particularly, in the eleventh aspect of the present invention, one of the cylinder (21) and the piston (22) as the two cooperating members (21, 22) can be thrust against the other by the appropriate amount of thrust force. That is, the thrust force to the cylinder (21) can be increased when the pressure of the outside cylinder chamber (C1) is high, for example, to increase the pitching moment causing inclination of the cylinder (21). In reverse, the thrust force to the cylinder (21) can be decreased when the pressure of the outside cylinder chamber (C1) is low. As a result, the sliding loss by the thrust force between the cylinder (21) and the piston (22) can be reduced.

Further, the lubricant oil is filled in the back pressure chamber (53), which means that the back pressure chamber (53) is filled with non-compressive fluid, and that no gas fluid is present therein. Accordingly, the pumping of the gas fluid can be prevented. That is, gas refrigerant sucking from the back pressure chamber (53) and gas refrigerant forcing into the back pressure chamber (53), which may be caused by pressure change in the operation chamber (C, 100), can be prevented, thereby reducing power loss.

In the second to fifth aspects of the present invention, the back flow checking mechanism (60) or the throttling mechanism (65) is provided at the oil passage (55). Accordingly, back flow of the lubricant oil when the back pressure chamber (53) is in the high pressure state can be prevented, thereby keeping the back pressure chamber (53) at a predetermined high pressure state. Particularly, in the case where the compression mechanism is the rotary mechanism (20), in driving in which the high pressure, i.e., the discharge pressure is low (for example, in low compression rate driving, start-up, and the like), compression failure caused by upset of the first cooperating member (21), which may be caused when the internal pressure of the casing is lower than the high pressure of the operation chambers (C1, C2, 100), can be avoided. In addition, when a passage having a valve mechanism for discharging the refrigerant from the operation chambers (C1, C2, 100) at the intermediate pressure to the high pressure side is provided, liquid compression can be prevented effectively, and the back pressure chamber (53) can be kept at the predetermined intermediate pressure.

In the sixth aspect of the present invention, the high pressure of the high pressure chamber (50) works on the first cooperating member (21, 120), so that the first cooperating member (21, 120) can be always thrust against the second cooperating member (22, 110) by the predetermined amount of thrust force. As a result, the behavior of the first cooperating member (21, 120) can be stabilized.

In the seventh aspect of the present invention, the predetermined amount of pressure of the constant pressure space (42) works on the first cooperating member (21, 120), so that the first cooperating member (21, 120) can be thrust against the second cooperating member (22, 110) by a minimum amount of thrust force. As a result, the behavior of the first cooperating member (21, 120) can be stabilized, and the optimum amount of thrust force can work on the first cooperating member (21, 120) even in a driving condition where the low pressure is high.

In the eighth aspect of the present invention, the center of gravity of the back pressure chamber (53) is eccentric from the axial center of the drive shaft (33), so that the point of application of the thrust force can agree with the center of action of opposite thrust force against the first cooperating member (21, 120) when the opposite thrust force is maximum. This can prevent pitching of the first cooperating member (21, 120) by small thrust force.

In the ninth aspect of the present invention, the operation chambers (C1, C2, 100) are located above the end plate (26, 121) of the first cooperating member (21, 120), and accordingly, discharge of the gas refrigerant can be ensured even when the gas refrigerant flows back to the oil passage (55).

In the tenth aspect of the present invention, both the back surface of the end plate (26, 121) of the first cooperating member (21, 120) and the opposed surface of the housing (17, 130) opposed to the back surface are flat, and therefore, the gas refrigerant can hardly be retained therebetween, thereby reducing oil agitation loss.

DETAILED DESCRIPTION OF THE INVENTION

Example embodiments of the present invention will be described in detail below with reference to the accompanying drawings.

Example Embodiment 1

Figure 1:
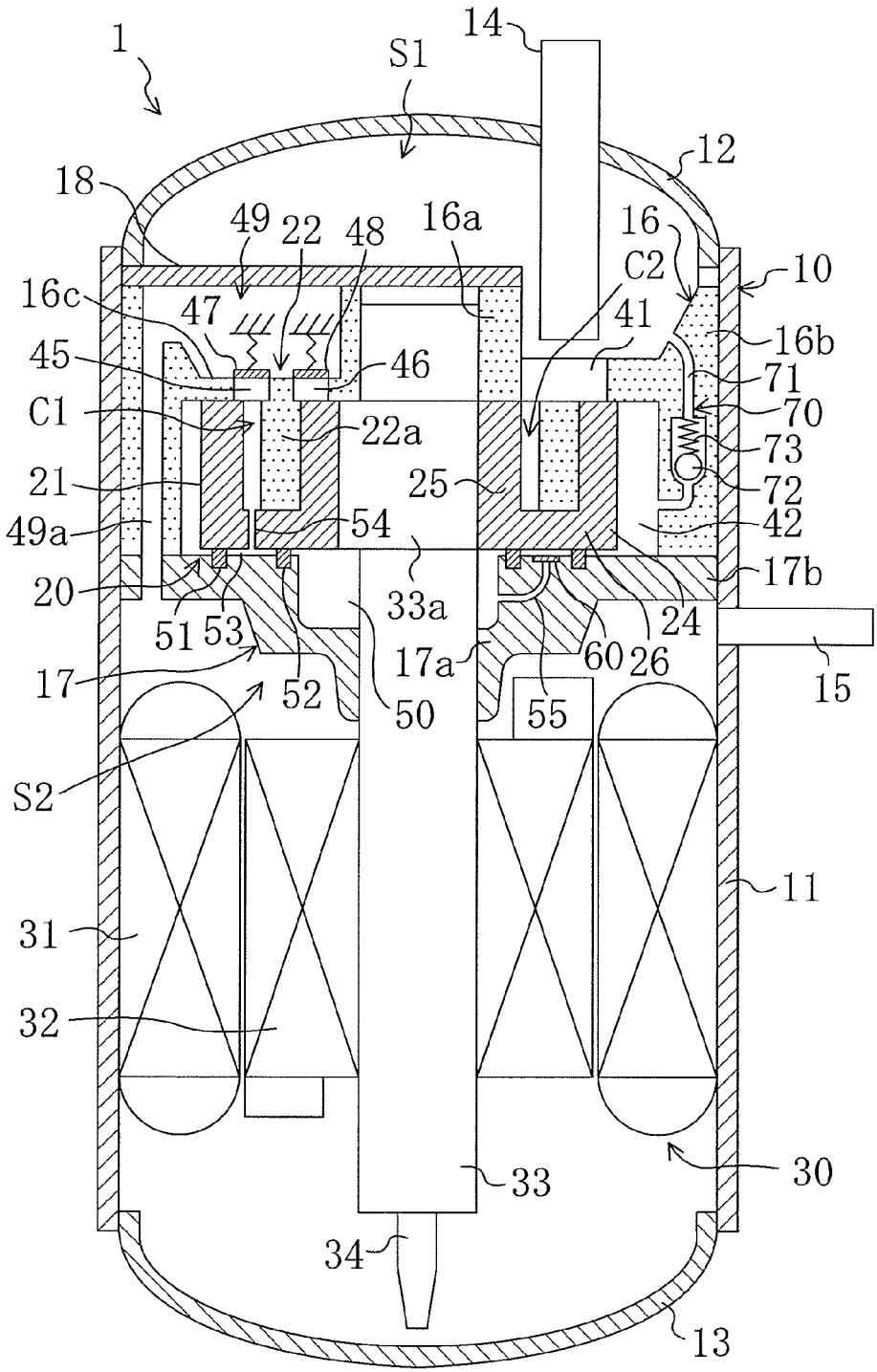
FIG. 1 is a vertical cross-sectional view of a rotary compressor in accordance with Example Embodiment 1 of the present invention.

In the present example embodiment, a rotary compressor (1) is applied to a fluid machinery, as shown in FIG. 1. The compressor (1) is a hermetically sealed compressor. A compression mechanism (20) as a rotary mechanism including an eccentric rotary piston (22) and a motor (30) as a driving mechanism are accommodated inside a casing (10) of the compressor (1). The compressor (1) is provided in a refrigerant circuit of, for example, an air conditioner to compress refrigerant sucked from an evaporator, and discharge it to a condenser.

The casing (10) includes a cylindrical body part (11), an upper head (12) fixed at the upper end of the body part (11), and a lower head (13) fixed at the lower end of the body part (11). A suction pipe is provided at the upper head (12), while a discharge pipe (15) is provided at the body part (11).

Inside the casing (10), an upper housing (16) and a lower housing (17) included in the compression mechanism (20) are fixed. Inside the casing (10), a low pressure space (S1) is formed above the upper housing (16), while a high pressure space (S2) is formed below the lower housing (17). The suction pipe (14) communicates with the low pressure space (S1), while the discharge pipe (15) communicates with the high pressure space (S2).

The motor (30) is disposed below the compression mechanism (20), and includes a stator (31) and a rotor (32). The stator (31) is fixed to the body part (11) of the casing (10). A drive shaft (33) is connected to the rotor (32), and passes vertically through the compression mechanism (20).

In the drive shaft (33), an oil passage (not shown) is formed to extend in the axial direction inside the drive shaft (33). An oil pump (34) is provided at the lower end of the drive shaft (33). The oil passage extends from the oil pump (34) to the compression mechanism (20) so that the oil pump (34) supplies lubricant oil in the bottom of the casing (10) to the sliding parts of the compression mechanism (20) through the oil passage.

At the upper part of the drive shaft (33), an eccentric part (33*a*) is formed. The eccentric part (33*a*) is eccentric by a predetermined amount from the axial center of the drive shaft (33).

Figure 2:
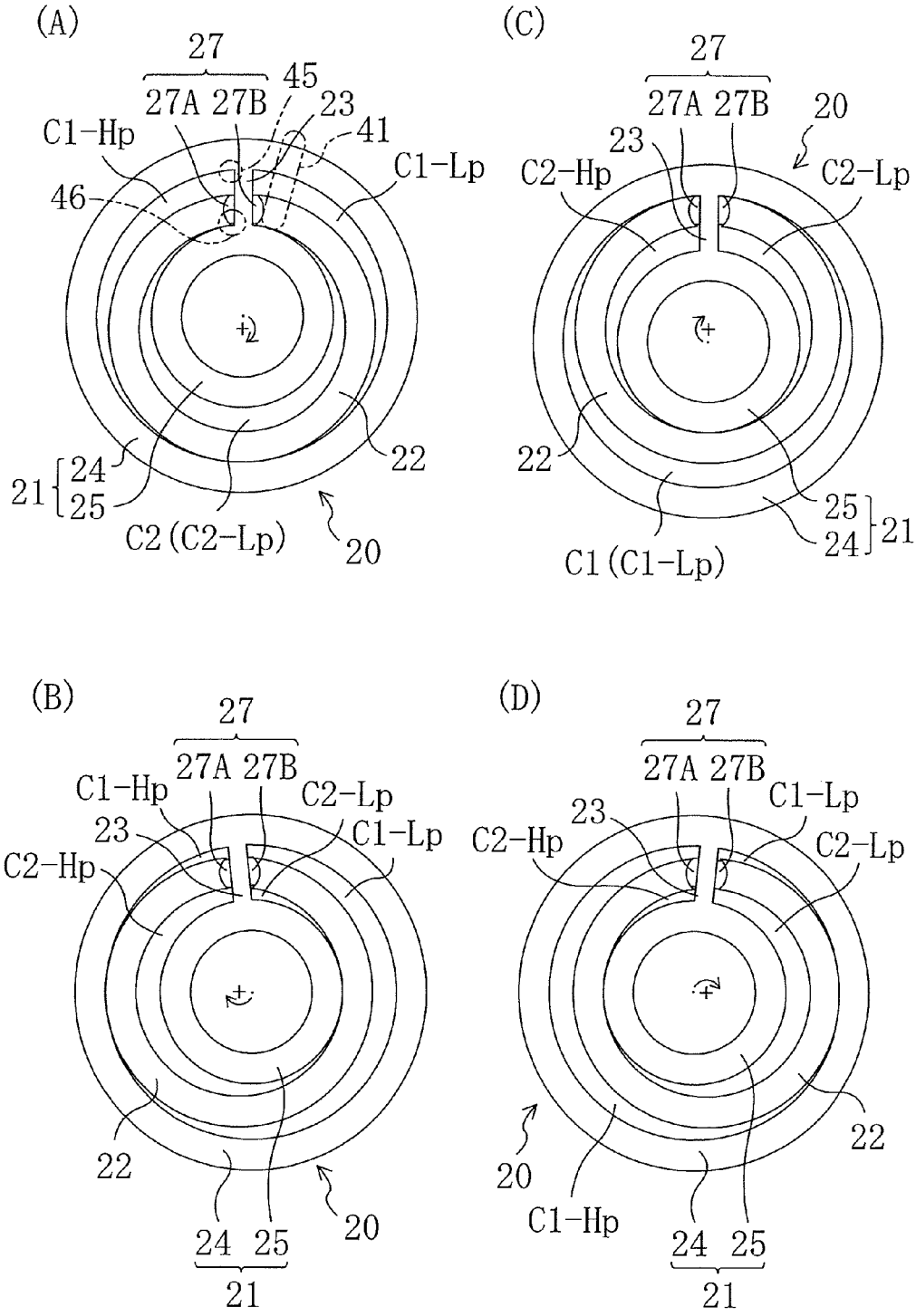
FIG. 2 is a transverse cross-sectional view showing an operation of a compression mechanism.

As shown in FIG. 2, the compression mechanism (20) includes a cylinder (21) having an annular cylinder chamber (C1, C2), the piston (22) having an annular piston member (22*a*) located inside the cylinder chamber (C1, C2), and a blade (23) defining the cylinder chamber (C1, C2) into a high pressure chamber (C1-Hp, C2-Hp) as a first chamber and a low pressure chamber (C1-Lp, C2-Lp) as a second chamber.

The cylinder (21) and the piston (22) form a rotary mechanism performing circulation movement in parallel and relative to each other, that is, are configured to perform relative eccentric rotation. In Example Embodiment 1, the cylinder (21) serves as an orbiting first cooperating member, while the piston (22) serves as a fixed second cooperating member.

The cylinder (21) includes an outside cylinder member (24) and an inside cylinder member (25) as engaging members, and an end plate (26) connecting the lower ends of the outside cylinder member (24) and the inside cylinder member (25). The inside cylinder member (25) is slidably fitted to the eccentric part (33*a*) of the drive shaft (33).

The inner peripheral surface of the outside cylinder member (24) and the outer peripheral surface of the inside cylinder member (25) are cylindrical and are arranged coaxially. An outside cylinder chamber (C1) as an operation chamber is formed between the outer peripheral surface of the annular piston member (22*a*) of the piston (22) and the inner peripheral surface of the outside cylinder member (24), while an inside cylinder chamber (C2) as an operation chamber is formed between the inner peripheral surface of the annular piston member (22*a*) of the piston (22) and the outer peripheral surface of the inside cylinder member (25). The cylinder chambers (C1, C2) are formed above the end plate (26) of the cylinder (21).

The piston (22) is integrally formed with the upper housing (16). The upper housing (16) includes a bearing (16*a*) at its central part, a bracket (16*b*) at its outer peripheral part fixed to the body part (11) of the casing (10), and a flat part (16*c*) connecting the bracket (16*b*) to the bearing (16*a*).

The annular piston member (22*a*) of the piston (22) is integrally formed with the flat part (16*c*) to protrude downward from the flat part (16*c*). The annular piston member (22*a*) serves as an engaging member, and is formed into a C-shape that is a circular shape from which a part is divided. The flat part (16*c*) serves also as an end plate of the piston (22). The flat part (16*c*) and the annular piston member (22*a*) form the piston (22).

The compression mechanism (20) includes a swing bush (27) as a connecting member movably connecting the piston (22) to the blade (23). The blade (23) extends on a radial line of the cylinder chamber (C1, C2) from the outer peripheral surface of the inside cylinder member (25) to the inner peripheral surface of the outside cylinder member (24). The blade (23) passes through the piston (22).

The swing bush (27) includes a discharge side bush (27A) and a suction side bush (27B). The discharge side bush (27A) is disposed beside the blade (23) on the side of the high pressure chambers (C1-Hp, C2-Hp), while the suction side bush (27B) is disposed beside the blade (23) on the side of the low pressure chambers (C1-Lp, C2-Lp). The bushes (27A, 27B) are formed substantially in a semicircular shape in section. The blade (23) is sandwiched between the opposed surfaces of the bushes (27A, 27B) so as to move back and forth. Simultaneously, the swing bushes (27A, 27B) swing integrally with the blade (23) with respect to the piston (22).

In the present example embodiment, the bushes (27A, 27B) are separated bodies. Alternatively, parts of the bushes (27A, 27B) may be integrated to be a single body.

Referring to the lower housing (17), it includes a bearing (17*a*) at its central part, and a flat part (17*b*) at its outer peripheral part continuing from the bearing (17*a*) and fixed to the body part (11) of the casing (10). The end plate (26) of the cylinder (21) is placed on the top surface of the flat part (17*b*). That is, both the back surface of the end plate (26) of the cylinder (21) and the top surface of the flat part (17*b*) opposed to the back surface are flat.

The bearings (16*a*, 17*a*) of the drive shaft (33) hold the upper housing (16) and the lower housing (17), respectively, to the casing (10).

In the flat part (16*c*) of the upper housing (16), there are formed a suction port (41) allowing the low pressure space (S1) above the compression mechanism (20) in the casing (10) to communicate with the outside cylinder chamber (C1) and the inside cylinder chamber (C2), a discharge port (45) for the outside cylinder chamber (C1), and a discharge port (46) for the inside cylinder chamber (C2).

Above the compression mechanism (20), a cover plate (18) is provided to form a discharge space (49) between it and the upper housing (16). The discharge space (49) communicates with the discharge ports (45, 46) via discharge valves (47, 48), and communicates with the high pressure space (S2) below the compression mechanism (20) through a discharge passage (49*a*) formed in the upper housing (16) and the lower housing (17).

Between the bracket (16*b*) of the upper housing (16) and the outside cylinder member (24), a constant pressure space (42) is formed of which the pressure is slightly higher than that of the low pressure space (S1).

Further, a central recess (50) opening upward is formed in the central part of the lower housing (17). Lubricant oil at a pressure higher than that of the oil supply passage (not shown) is supplied to the central recess (50), and accordingly, the central recess (50) serves as a high pressure chamber to thrust the cylinder (21) against the piston (22) from the back surface of the end plate (26). Two seal rings (51, 52) are provided in the flat part (17*a*) of the lower housing (17). The seal rings (51, 52) are fitted in annular grooves of the lower housing (17) to be in contact with the lower surface of the end plate (26) of the cylinder (21).

Between the flat part (17*a*) of the lower housing (17) and the end plate (26) of the cylinder (21), the back pressure chamber (53) is formed between the seal rings (51, 52). A communication passage (54) is formed in the end plate (26) of the cylinder (21) to pass through the end plate (26). The communication passage (54) allows the back pressure chamber (53) to communicate with the outside cylinder chamber (C1) to introduce refrigerant at an intermediate pressure from the outside cylinder chamber (C1) in an intermediate pressure state into the back pressure chamber (53). The refrigerant at the intermediate pressure in the back pressure chamber (53) thrusts the cylinder (21) against the piston (22). That is, by the refrigerant at the intermediate pressure changing in the outside cylinder chamber (C1), the tip end surfaces (the top surfaces) of the outside cylinder member (24) and the inside cylinder member (25) are thrust against the flat part (16*e*) of the upper housing (16), while the tip end surface (the lower surface) of the annular piston member (22*a*) is thrust against the end plate (26) of the cylinder (21).

Further, an oil passage (55) is formed in the bearing (17*a*) of the lower housing (17). The oil passage (55) allows the central recess (50) to communicate with the back pressure chamber (53), thereby introducing the lubricant oil at a high pressure of the central recess (50) into the back pressure chamber (53). In other words, the back pressure chamber (53) is configured to be filled with the oil.

Figure 3:
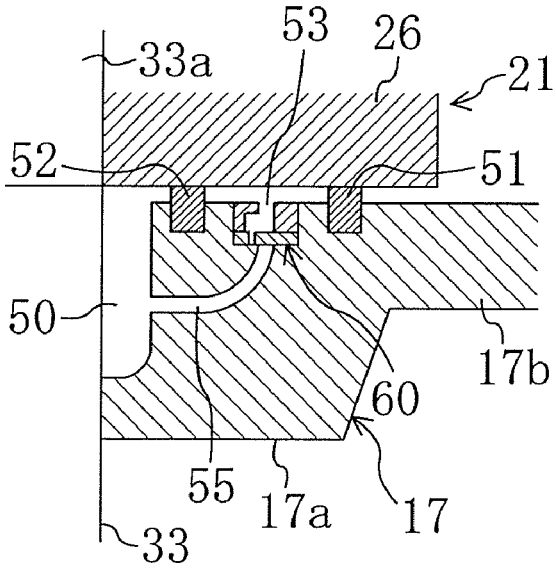
FIG. 3 is a cross-sectional view in an enlarged scale showing the vicinity of a back pressure chamber.
Figure 4:
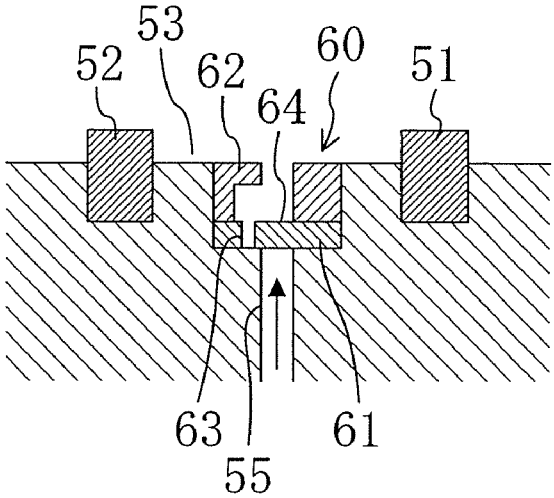
FIG. 4 is a cross-sectional view in an enlarged scale showing a one-way valve.
Figure 5:
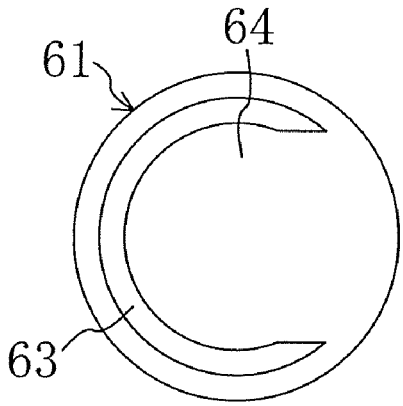
FIG. 5 is a plan view of a valve body of the one-way valve.

In the oil passage (55), a one-way valve (60) is provided as shown in FIG. 3 to FIG. 5. The one-way valve (60) is provided at the end of the oil passage (55) on the side of the back pressure chamber (53) to allow only flow toward the back pressure chamber (53) from the central recess (50). The one-way valve (60) serves as a back flow checking mechanism, includes a valve body (61) and a valve retainer (62), and is fitted in the flat part (17*b*). The valve body (61) is in a disk shape, in which a C-shaped notch (63) is formed to form a tongue-shaped valve portion (64). The valve retainer (62) is provided at the opening end of the oil passage (55), and a valve space for allowing the valve body (64) to bend is formed.

The center of the two seal rings (51, 52) is eccentric from the axial center of the drive shaft (33). In other words, the center of gravity of the back pressure chamber (53) is eccentric from the axial center of the drive shaft (33). The center of gravity of the back pressure chamber (53) agrees with the center of action of opposite thrust force by the pressure of the refrigerant in the two cylinder chambers (C1, C2) (force that thrusts the cylinder (21) against the lower housing (17)) when the opposite thrust force is maximum.

Furthermore, a pressure adjusting mechanism (70) is provided between the constant pressure space (42) and the low pressure space (S1). The pressure adjusting mechanism (70) is provided at the bracket (16*b*) of the upper housing (16), and includes an adjusting passage (71), a ball valve (72), and a spring (73). The ball valve (72) and the spring (73) are provided in the middle of the adjusting passage (71). The constant pressure space (42) is so configured that the intermediate pressure of the back pressure chamber (53) works on the constant pressure space (42) through the seal ring (51), and the pressure of the constant pressure space (42) is released to the low pressure space (S1) when the pressure of the constant pressure space (42) is higher than a predetermined pressure of which a value is obtained by adding the bias force of the spring (73) to a low pressure of the low pressure space (S1). That is, the constant pressure space (42) is kept at the predetermined pressure between the intermediate pressure of the back pressure chamber (53) and the low pressure of the low pressure space (51), and this predetermined amount of pressure thrusts the cylinder (21) against the piston (22).

Hence, the pressure outside the outside seal ring (51) is slightly higher than the suction pressure of the low pressure space (S1). The pressure between the outside seal ring (51) and the inside seal ring (52) is the intermediate pressure of the back pressure chamber (53). The pressure inside the inside seal ring (52) is the discharge pressure of the central recess (50).

—Driving Operation—

A driving operation of the above-described rotary compressor (1) will be described next.

First, when the motor (30) starts, the cylinder (21) swings with respect to the piston (22). That is, the outside cylinder member (24) and the inside cylinder member (25) revolve while swinging with respect to the piston (22) to cause the compression mechanism (20) to perform a predetermined compression operation.

Specifically, in the outside cylinder chamber (C1), the volume of the low pressure chamber (C1-Lp) is almost minimum in the state shown in FIG. 2(D). From this state, the drive shaft (33) rotates clockwise in the drawing to be in the states shown in FIG. 2(A), FIG. 2(B), then FIG. 2(C) to increase the volume of the low pressure chamber (C1-Lp), so that the refrigerant is sucked into the low pressure chamber (C1-Lp) through the suction pipe (14), the low pressure space (S1), and the suction port (41).

When the drive shaft (33) makes one rotation to be in the state shown in FIG. 2(D) again, refrigerant suction to the low pressure chamber (C1-Lp) terminates. The low pressure chamber (C1-Lp) then becomes the high pressure chamber (C1-Hp) for compressing the refrigerant, and a new low pressure chamber (C1-Lp) isolated by the blade (23) is formed. When the drive shaft (33) further rotates, refrigerant suction is repeated in the low pressure chamber (C1-Lp), while the volume of the high pressure chamber (C1-Hp) decreases to compress the refrigerant in the high pressure chamber (C1-Hp). When the pressure of the high pressure chamber (C1-Hp) is a predetermined value, and the pressure difference from the discharge space (49) reaches a predetermined value, the high pressure refrigerant in the high pressure chamber (C1-Hp) opens the discharge valve (47) to flow from the discharge space (49) to the high pressure space (S2) through the discharge passage (49*a*).

On the other hand, in the inside cylinder chamber (C2), the volume of the low pressure chamber (C2-Lp) is almost minimum in the state shown in FIG. 2(B). From this state, the drive shaft (33) rotates clockwise in the drawing to be in the states shown in FIG. 2(C), FIG. 2(D), then FIG. 2(A) to increase the volume of the low pressure chamber (C2-Lp), so that the refrigerant is sucked into the low pressure chamber (C2-Lp) through the suction pipe (14), the low pressure space (S1), and the suction port (41).

When the drive shaft (33) makes one rotation to be in the state shown in FIG. 2(B) again, refrigerant suction to the low pressure chamber (C2-Lp) terminates. The low pressure chamber (C2-Lp) then becomes the high pressure chamber (C2-Hp) for compressing the refrigerant, and a new low pressure chamber (C2-Lp) isolated by the blade (23) is formed. When the drive shaft (33) further rotates, refrigerant suction is repeated in the low pressure chamber (C2-Lp), while the volume of the high pressure chamber (C2-Hp) decreases to compress the refrigerant in the high pressure chamber (C2-Hp). When the pressure of the high pressure chamber (C2-Hp) is a predetermined value, and the pressure difference from the discharge space (49) reaches a predetermined value, the high pressure refrigerant in the high pressure chamber (C2-Hp) opens the discharge valve (48) to flow from the discharge space (49) to the high pressure space (S2) through the discharge passage (49*a*).

The high pressure refrigerant in the high pressure space (S2) is discharged from the discharge pipe (15), undergoes the condensation stroke, the expansion stroke, and the evaporation stroke in the refrigerant circuit, and then is sucked into the compressor (1) again. The above described operation is repeated.

During the above described compression operation, the oil supply pump (64) supplies the lubricant oil in the bottom of the casing (10) to the sliding parts of the compression mechanism (20) through the oil passage (not shown) in the drive shaft (33), and also to the central recess (50). The lubricant oil at a high pressure in the central recess (50) thrusts the central part of the back surface of the end plate (26) of the cylinder (21) against the piston (22).

On the other hand, the intermediate pressure of the refrigerant in the intermediate pressure state in the outside cylinder chamber (C1) works on the back pressure chamber (53) through the communication passage (54). At the same time, lubricant oil at the high pressure is supplied from the central recess (50) to the back pressure chamber (53) though the oil passage (55). Accordingly, the back pressure chamber (53) is filled with the lubricant oil, and is kept in the intermediate pressure state of the outside cylinder chamber (C1). This intermediate pressure thrusts the back surface of the end plate (26) of the cylinder (21) against the piston (22). Specifically, when the intermediate pressure is low due to change in pressure state of the outside cylinder chamber (C1) according to swinging of the cylinder (21), this low pressure thrusts the cylinder (21) against the piston (22). When the intermediate pressure is high, this high pressure thrusts the cylinder (21) against the piston (22).

Further, if the pressure of the outside cylinder chamber (C1) increases excessively over the high pressure, i.e., the discharge pressure, the one-way valve (60), which is provided at the communication passage (54), prevents back flow of the lubricant oil and the like from the back pressure chamber (53) to the central recess (50).

Further, the constant pressure space (42) is kept at the predetermined pressure between the intermediate pressure of the back pressure chamber (53) and the low pressure of the low pressure space (S1), so that the cylinder (21) is always thrust against the piston (22) by a minimum amount of thrust force.

Advantages of Example Embodiment 1

In the present example embodiment, the intermediate pressure of the back pressure chamber (53) at the back surface of the cylinder (21) is changed according to the pressure state of the outside cylinder chamber (C1), and hence, the cylinder (21) can be thrust against the piston (22) by an appropriate amount of thrust force. That is, when the pressure of the outside cylinder chamber (C1) is high to increase the pitching moment causing inclination of the cylinder (21), the thrust force to the cylinder (21) can be increased. In reverse, when the pressure of the outside cylinder chamber (C1) is low, the thrust force to the cylinder (21) can be reduced. As a result, the sliding loss by the thrust force between the cylinder (21) and the piston (22) can be reduced.

Further, the lubricant oil is filled in the back pressure chamber (53), which means that the back pressure chamber (53) is filled with non-compressive fluid, and that no gas refrigerant is present in the back pressure chamber (53). Hence, pumping of the gas refrigerant can be prevented. Specifically, a gas refrigerant flow out of the back pressure chamber (53) and a gas refrigerant flow into the back pressure chamber (53), which are caused by pressure change of the outside cylinder chamber (C1), can be prevented, thereby reducing power loss.

In addition, provision of the one-way valve (60) at the oil passage (55) can prevent back flow of the lubricant oil at the time when the back pressure chamber (53) is in a high pressure state, thereby keeping the back pressure chamber (53) in the predetermined high pressure state.

Particularly, in driving in which the high pressure, i.e., the discharge pressure is low (for example, in low compression rate driving, start up, and the like), compression failure by upset of the cylinder (21), which may be caused when the internal pressure of the casing (10) is lower than the high pressure of the operation chambers (C1, C2), can be avoided. In addition, if a passage having a valve mechanism for discharging the refrigerant at the intermediate pressure in the cylinder chambers (C1, C2) to the high pressure side is provided, the back pressure chamber (53) can be kept at the predetermined intermediate pressure, and liquid compression can be prevented effectively.

Further, the high pressure of the central recess (50) works on the cylinder (21), so that the cylinder (21) can be always thrust against the piston (22) by a predetermined amount of thrust force. As a result, the behavior of the cylinder (21) can be stabilized.

Furthermore, the predetermined amount of pressure of the constant pressure space (42) works on the cylinder (21), so that the cylinder (21) can be thrust against the piston (22) by a minimum amount of thrust force. As a result, the behavior of the cylinder (21) can be stabilized, and the optimum amount of thrust force can work on the cylinder (21) even in a condition where the low pressure is high.

Moreover, the center of gravity of the back pressure chamber (53) is eccentric from the axial center of the drive shaft (33), so that the point of application of the thrust force agrees with the center of action of opposite thrust force against the cylinder (21) when the opposite thrust force is maximum. As a result, pitching of the cylinder (21) can be prevented by a small amount of thrust force.

Further, since the cylinder chambers (C1, C2) are located above the end plate (26) of the cylinder (21), discharge of the gas refrigerant can be ensured even when the gas refrigerant flows back to the oil passage (55).

In addition, both the back surface of the end plate (26) of the cylinder (21) and the top surface of the flat part (17*c*) opposed to the back surface are flat, and accordingly, the gas refrigerant can hardly be retained therebetween, thereby reducing oil agitation loss.

Modified Example of Example Embodiment 1

Figure 6:
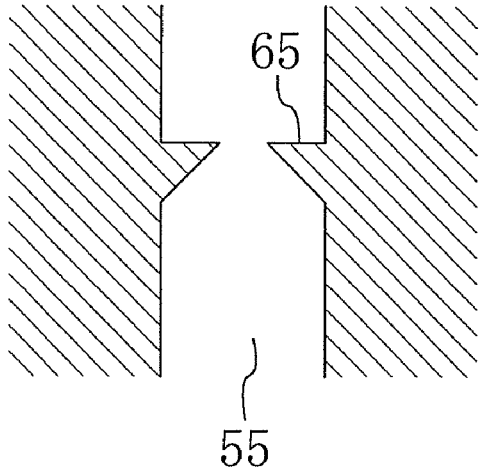
FIG. 6 shows a modified example of Example Embodiment 1, and is a cross-sectional view in an enlarged scale showing a fluid diode.

As shown in FIG. 6, a fluid diode (65) may be provided rather than the one-way valve (60) as a back flow checking mechanism (60). The fluid diode (65) forms a throttling mechanism, and is provided in the middle of the oil passage (55) to throttle the middle part of the oil passage (55), thereby preventing the back flow. Two or more fluid diodes (65) may be provided, of course.

Example Embodiment 2

Example Embodiment 2 of the present invention will be described next in detail with reference to the drawing.

Figure 7:
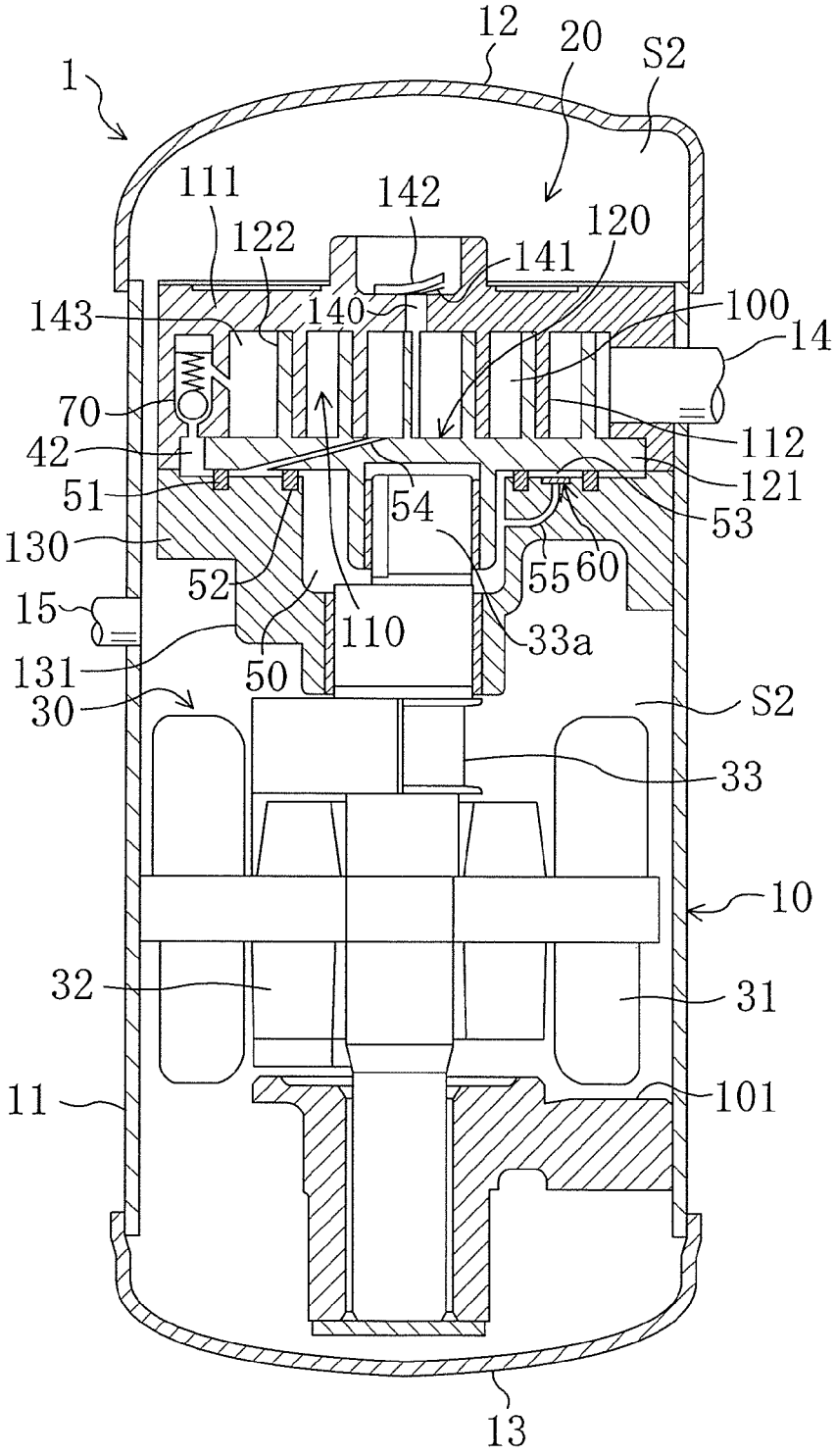
FIG. 7 is a vertical cross-sectional view of a rotary compressor in accordance with Example Embodiment 2 of the present invention.

In the present example embodiment, a scroll compressor as shown in FIG. 7 is employed as the compression mechanism (20) unlike Example Embodiment 1 employing the eccentric rotation type piston mechanism. The inside space of the casing (10) of the rotary compressor (1) in the present example embodiment is defined into an upper space and a lower space by the compression mechanism (20). The upper space and the lower space communicate with each other to serve as the high pressure space (S2).

The compression mechanism (20) is a rotary mechanism in which a first cooperating member and a second cooperating member perform circulation movement in parallel and relative to each other, and includes a fixed scroll (110) as a second cooperating member, an orbiting scroll (120) as a first cooperating member, and a housing (130). The housing (130) is fixed to the casing (10), and serves as a support member supporting the orbiting scroll (120) from below.

The fixed scroll (110) includes an end plate (111) and a scroll wrap (112) as an engaging member formed on the end plate (111). The orbiting scroll (120) includes an end plate (121) and a scroll wrap (122) as an engaging member formed on the end plate (121). The fixed scroll (110) and the orbiting scroll (120) are arranged so that the respective wraps (112, 122) are in engagement with each other. The scrolls (110, 120) define and form compression chambers (100) as operation chambers between the warps (112, 122) and between the end plates (121 111).

Around the fixed scroll (110), a suction space (143) for sucking the refrigerant at a low pressure into compression chambers (100) are formed. A discharge port (140) for discharging the refrigerant compressed in the compression chambers (100) is formed in the central part of the fixed scroll (110). A discharge valve (141) and a valve retainer (142) for the discharge port (28) are provided at the fixed scroll (110).

The fixed scroll (110) is fixed to the housing (130), while the orbiting scroll (120) is disposed on the housing (130) with an Oldham ring (not shown) interposed. The back surface (the lower surface) of the orbiting scroll (120) is connected to the eccentric part (33*a*) of the drive shaft (33).

When the drive shaft (33) rotates, the orbiting scroll (120) revolves on a revolution orbit having a revolution radius equal to the eccentric amount of the eccentric part (33*a*) from the rotation center of the drive shaft (33). The Oldham ring prevents rotation of the orbiting scroll (120). Accordingly, the orbiting scroll (120) only revolves without rotating to continuously change the volume of the compression chambers (100) formed between the wraps (112, 122) of the scrolls (110, 120).

At the central part of the housing (130), a bearing (131) of the drive shaft (33) is disposed, and the central recess (50) similar to that in Example Embodiment 1 is formed. The lubricant oil is supplied to the central recess (50). The top surface of the housing (130) is formed flat, and the two seal rings (51, 52) similar to those in Example Embodiment 1 are provided to form the back pressure chamber (53).

Similar to the case in Example Embodiment 1, the back pressure chamber (53) communicates with the central recess (50) through the oil passage (55) including the one-way valve (60), and communicates with the compression chambers (100) through the communication passage (54).

The constant pressure space (42) is formed between the fixed scroll (110) and the outer peripheral part of the top surface of the housing (130). The constant pressure space (42) communicates with the suction space (143) as a low pressure space via the pressure adjusting mechanism (70), similarly to the case in Example Embodiment 1.

The lower end of the drive shaft (33) is fixed to the casing (10) by means of a bearing (101). The back pressure chamber (53), the one-way valve (60), the pressure adjusting mechanism (70), and the like have the same configurations as those in Example Embodiment 1.

—Driving Operation—

During the compression operation of the above describe rotary compressor (1), the lubricant oil in the bottom of the casing (10) is supplied to the sliding parts of the compression mechanism (20) through the oil passage (not shown) in the drive shaft (33), and is also supplied to the central recess (50). The lubricant oil at a high pressure in the central recess (50) thrusts the central part of the back surface of the end plate (121) of the orbiting scroll (120) against the fixed scroll (110).

Furthermore, intermediate pressure of the refrigerant in an intermediate pressure state in compression chambers (100) works on the back pressure chamber (53). At the same time, the lubricant oil at the high pressure is supplied to the back pressure chamber (53) from the central recess (50) through the oil passage (55). Accordingly, the back pressure chamber (53) is filled with the lubricant oil, and is kept in the intermediate pressure state of the compression chambers (100), so that this intermediate pressure thrusts the buck surface of the end plate (121) of the orbiting scroll (120) against the fixed scroll (110).

Since the one-way valve (60) is provided at the communication passage (54), the lubricant oil and the like can be prevented from flowing back to the central recess (50) from the back pressure chamber (53) when the pressure of the compression chambers (100) increases excessively over the high pressure, i.e., the discharge pressure.

Further, the constant pressure space (42) is kept at the predetermined pressure between the intermediate pressure of the back pressure chamber (53) and the low pressure of the suction space (143), so that the orbiting scroll (120) is always thrust against the fixed scroll (110) by a minimum amount of thrust force. The other operations of the back pressure chamber (53) and the like are the same as those in Example Embodiment 1.

Advantages of Example Embodiment 2

Thus, in the present example embodiment, the intermediate pressure of the back pressure chamber (53) at the back surface of the orbiting scroll (120) is changed according to the pressure state of the compression chambers (100), and hence, the orbiting scroll (120) can be thrust against the fixed scroll (110) by an appropriate amount of thrust force.

In addition, the lubricant oil is filled in the back pressure chamber (53), which means that the back pressure chamber (53) is filled with non-compressive fluid, and that no gas refrigerant is present in the back pressure chamber (53). This prevents pumping of the gas refrigerant. That is, gas refrigerant sucking from the back pressure chamber (53) and gas refrigerant forcing into the back pressure chamber (53), which may be caused by pressure change in the compression chambers (100), can be prevented, thereby reducing power loss.

Particularly, provision of the one-way valve (60) at the oil passage (55) can prevent back flow of the lubricant oil when the back pressure chamber (53) is in a high pressure state, thereby keeping the back pressure chamber (53) in the predetermined high pressure state. Moreover, in driving in which the high pressure, i.e., the discharge pressure is low (for example, in low compression rate driving, start up, and the like), compression failure by upset of the orbiting scroll (120), which may be caused when the internal pressure of the casing (10) is lower than the high pressure of the compression chambers (100), can be avoided. Moreover, if a passage having a valve mechanism for discharging the refrigerant from the compression chambers (100) at the intermediate pressure to the high pressure side is provided, the back pressure chamber (53) can be kept at the predetermined intermediate pressure, and liquid compression can be prevented effectively. The other advantages are the same as those in Example Embodiment 1.

Other Example Embodiments

The present invention may have any of the following configurations in Example Embodiments 1 and 2.

The communication passage (54) allows the back pressure chamber (53) to communicate with the outside cylinder chamber (C1) in Example Embodiment 1, but may allow the back pressure chamber (53) to communicate with the inside cylinder chamber (C2).

Alternatively, one end of the communication passage (54) may be configured to switch communication of the back pressure chamber (53) with either the outside cylinder chamber (C1) or the inside cylinder chamber (C2). In this case, excessive thrust force can be generated only when required, thereby ensuring prevention of upset of the cylinder chambers (C1, C2) upon application of a maximum upset load.

The only one back pressure chamber (53) is provided in Example Embodiment 1, but two or more back pressure chambers (53) respectively communicating with the outside cylinder chamber (C1) and the inside cylinder chamber (C2) may be provided. In this case, optimum amounts of thrust force corresponding to the outside cylinder chamber (C1) and the inside cylinder chamber (C2) can be generated.

Example Embodiments 1 and 2 refer to the compressors, but the present invention is applicable to various types of fluid machineries, such as an expander.

In Example Embodiment 1, the cylinder (21) serves as an orbiting first cooperating member, while the piston (22) serves as a fixed second cooperating member. The present invention may have a configuration in which the cylinder (21) serves as a fixed second cooperating member, while the piston (22) serves as an orbiting first cooperating member.

The above described example embodiments are substantially mare preferable examples, and are not intended to limit the scope of the present invention, applicable subjects, and uses.

INDUSTRIAL APPLICABILITY

As described above, the present invention is useful in fluid machineries in which the volumes of operation chambers formed between two cooperating members are changed.

What is claimed is:

1. A fluid machinery comprising:

a rotary mechanism including a first cooperating member and a second cooperating member, each of the first and second cooperating members including an engaging member extending from a front surface of an end plate, with the first and second cooperating members being arranged to oscillate in parallel relative to each in order to change volumes of operation chambers formed between the first and second cooperating members;

an annular back pressure chamber provided at a back surface side of the end plate of the first cooperating member, the annular back pressure chamber being arranged to communicate with an intermediate operation chamber of the operation chambers to thrust the first cooperation member against the second cooperating member, with the intermediate operation chamber being in an intermediate pressure state;

an oil passage arranged to communicate an oil into the back pressure chamber to fill the back pressure chamber with the oil; and a high pressure chamber formed on the back surface side of the end plate of the first cooperating member, the high pressure chamber being disposed between the back pressure chamber and a drive shaft connected to the first cooperating member, the high pressure chamber being provided with high pressure oil and maintained in a high pressure state, the high pressure chamber being separate from the back pressure chamber, the oil passage communicating between the back pressure chamber and the high pressure chamber.

2. The fluid machinery of claim 1, further comprising a back flow checking mechanism provided at the oil passage.

3. The fluid machinery of claim 2, wherein the back flow checking mechanism includes a one-way valve that closes when a pressure of the intermediate operation chamber is at least a predetermined high pressure.

4. The fluid machinery of claim 1 further comprising a throttling mechanism provided at the oil passage.

5. The fluid machinery of claim 4, wherein the throttling mechanism includes a fluid diode.

6. The fluid machinery of claim 1, further comprising a constant pressure space formed on the back surface side of the end plate of the first cooperating member that is separate from the back pressure chamber, the constant pressure space being in a pressure state between a low pressure state and the intermediate pressure state.

7. The fluid machinery of claim 1, wherein a center of the back pressure chamber is eccentrically disposed relative to an axial center of the drive shaft, and the drive shaft is arranged to drive the first cooperating member.

8. The fluid machinery of claim 1, wherein the operation chambers are located above the end plate of the first cooperating member.

9. The fluid machinery of claim 1, wherein the back surface of the end plate of the first cooperating member and an opposed surface of a housing are flat.

10. The fluid machinery of claim 1, wherein one of the first and second cooperating members includes a cylinder having an outside cylinder member and an inside cylinder member to form an annular cylinder chamber therebetween, with the outside and inside cylinder members forming the engaging member of the one of the first and second cooperating members, the other of the first and second cooperating members includes a piston having an annular piston member disposed in the annular cylinder chamber, the annular piston member having a center that is eccentrically disposed relative to the cylinder, and the annular piston member dividing the annular cylinder chamber into an outside operation chamber and an inside operation chamber, with the annular piston member forming the engaging member of the other of the first and second cooperating members, and the rotary mechanism includes a blade dividing each of the outside and inside operation chambers into a high pressure side and a low pressure side, with the blade being configured to allow the piston and the cylinder to perform relative rotation.

11. The fluid machinery of claim 1, wherein the first cooperating member includes an orbiting scroll having a scroll wrap that forms the engaging member of the first cooperating member, the second cooperating member includes a fixed scroll having a scroll wrap that forms the engaging member of the second cooperating member, and the rotary mechanism is arranged and configured so that the orbiting scroll revolves with respect to the fixed scroll without rotating with the wraps of the fixed scroll and the orbiting scroll being in engagement with each other.

12. The fluid machinery of claim 1, wherein the rotary mechanism is a compression mechanism arranged and configured to compress an operation fluid in the operation chambers.

* * * * *